US012808102B2

(12) United States Patent
Haynes

(10) Patent No.: US 12,808,102 B2
(45) Date of Patent: Nov. 24, 2026

(54) MELTBLOWN SYSTEM

(71) Applicant: Kimberly-Clark Worldwide, Inc., Neenah, WI (US)

(72) Inventor: Bryan D. Haynes, Jasper, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 120 days.

(21) Appl. No.: 18/270,691

(22) PCT Filed: Dec. 29, 2021

(86) PCT No.: PCT/US2021/065464
§ 371 (c)(1),
(2) Date: Jun. 30, 2023

(87) PCT Pub. No.: WO2022/147086
PCT Pub. Date: Jul. 7, 2022

(65) Prior Publication Data

US 2024/0076815 A1 Mar. 7, 2024

Related U.S. Application Data

(60) Provisional application No. 63/132,407, filed on Dec. 30, 2020.

(51) Int. Cl.

| | |
|---|---|
| ***D04H 1/732*** | (2012.01) |
| ***D01D 4/02*** | (2006.01) |
| ***D04H 1/56*** | (2006.01) |

(52) U.S. Cl.
CPC ..... *D04H 1/732* (2013.01); *D01D 4/025* (2013.01); *D04H 1/565* (2013.01)

(58) Field of Classification Search
CPC ..... D01D 4/025; D01D 4/08; D01D 4/027; D01D 4/02
See application file for complete search history.

(56) References Cited

U.S. PATENT DOCUMENTS

| | | | | |
|---|---|---|---|---|
| 5,098,636 A * | 3/1992 | Balk | ..... | D04H 1/4291 425/72.2 |
| 5,196,207 A | 3/1993 | Koenig | | |
| 5,248,247 A | 9/1993 | Rubhausen et al. | | |

(Continued)

FOREIGN PATENT DOCUMENTS

| | | |
|---|---|---|
| CN | 1395630 A | 2/2003 |
| WO | 2001046505 A2 | 6/2001 |

*Primary Examiner* — Matthew J Daniels
(74) *Attorney, Agent, or Firm* — Dority & Manning, P.A.

(57) ABSTRACT

Systems, methods and apparatus for a meltblown die comprising a die body; a die tip mounted to the die body and having one or more capillaries, wherein the die tip is configured to direct polymer out through the one or more capillaries into a forming zone, a plurality of passages having an interior region and configured to direct attenuating fluid through the interior region and out into the forming zone; and an air management device having a plurality of air shaping devices, wherein the air management device is at least partially within at least one of the plurality of passages, and the plurality of air shaping devices are configured to re-arrange air flow in the at least one of the plurality of passages to reduce turbulence of the attenuating fluid in at least one of the interior region and the forming zone.

19 Claims, 9 Drawing Sheets

(56) References Cited

U.S. PATENT DOCUMENTS

| | | | | |
|---|---|---|---|---|
| 6,972,104 | B2 * | 12/2005 | Haynes | D01D 5/0985 425/382.2 |
| 12,275,183 | B2 * | 4/2025 | Katzman | B29C 51/424 |
| 2002/0089093 | A1 | 7/2002 | Fish et al. | |
| 2004/0086588 | A1 | 5/2004 | Haynes et al. | |
| 2006/0091582 | A1 | 5/2006 | James et al. | |
| 2019/0360138 | A1 * | 11/2019 | Nitschke | D04H 3/077 |

* cited by examiner

MELTBLOWN SYSTEM

This application claims priority to and benefit of U.S. Patent Application Ser. No. 63/132,407, filed on 30 Dec. 2020, entitled MELTBLOWN SYSTEM, the entire contents of which are herein incorporated by reference.

The present invention generally relates to a meltblown die and method of making meltblown fibers.

BACKGROUND

Meltblowing is a process to form fibers and nonwoven webs where the fibers are formed by extruding a molten thermoplastic material (polymer) through a collection of small diameter capillaries. The resulting molten threads or filaments pass into converging high velocity gas streams, which are often heated, that attenuate or draw the filaments of molten polymer to reduce their diameters. Thereafter, the meltblown fibers are carried by the gas streams and deposited on a collecting surface, or forming wire, to form a nonwoven web of randomly dispersed meltblown fibers.

As described above, for a meltblowing process, polymer flows out of a die through small diameter capillaries to form meltblown fibers. These fibers can be attenuated or stretched by high velocity gas streams to diameters from, for example, about 0.1 to 10 micrometers. Given such fine diameter fibers and the close proximity of the capillaries (e.g., to achieve high throughputs), controlling the gas streams attenuating the polymer flows is crucial to ensure the streams don't produce unnecessary turbulence and cause the flows to impact one another and degrade the formation of the nonwoven material.

SUMMARY

In general, the subject matter of this specification relates to meltblowing processes and equipment. One aspect of the subject matter described in this specification can be implemented in systems that include a meltblown die comprising a die body; a die tip mounted to the die body and having one or more capillaries, wherein the die tip is configured to direct polymer out through the one or more capillaries into a forming zone, a plurality of passages having an interior region and configured to direct attenuating fluid through the interior region and out into the forming zone; and an air management device having a plurality of air shaping devices, wherein the air management device is at least partially within at least one of the plurality of passages, and the plurality of air shaping devices are configured to re-arrange air flow in the at least one of the plurality of passages to reduce turbulence of the attenuating fluid in at least one of the interior region and the forming zone. Other embodiments of this aspect include corresponding methods.

Yet another aspect of the subject matter described in this specification can be implemented in methods including directing fluid flow through a plurality of non-rectangular passages in through a die to a die outlet to attenuate polymer extruded by the die, wherein at least one of the plurality of passages has an air management device having a plurality of air shaping devices; and re-arranging, by the respective plurality of air shaping devices, the fluid flow in the at least one of the plurality of passages. Other embodiments of this aspect include corresponding systems and apparatus.

Particular embodiments of the subject matter described in this specification can be implemented so as to realize one or more of the following advantages. For example, as meltblown fibers move towards lower deniers, smaller diameters, and/or higher throughputs, the more important controlling the air (attenuating fluid) flow attenuating those fibers becomes because the fibers have less mass per given length and are thus more easily influenced by the air flow. Further, the fibers can be in closer proximity to each other (e.g., by virtue of a higher density per unit area of capillaries in the die tip to achieve increased throughputs) and can more easily contact each other if the air flow is not well controlled, where such contacting can cause the fibers to stick together (e.g., clump) resulting in poor nonwoven web formation or other processing issues.

To address these issues, the meltblown equipment and processes described herein use (i) air management devices in the passages directing the attenuating air flows and/or (ii) passages with rounded cross sections to reduce the turbulence in the attenuating air flows. This results in better control and formation of the polymer flows allowing smaller diameter fibers and/or increased throughputs (e.g., through higher capillary densities) while maintaining quality nonwoven web formation.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
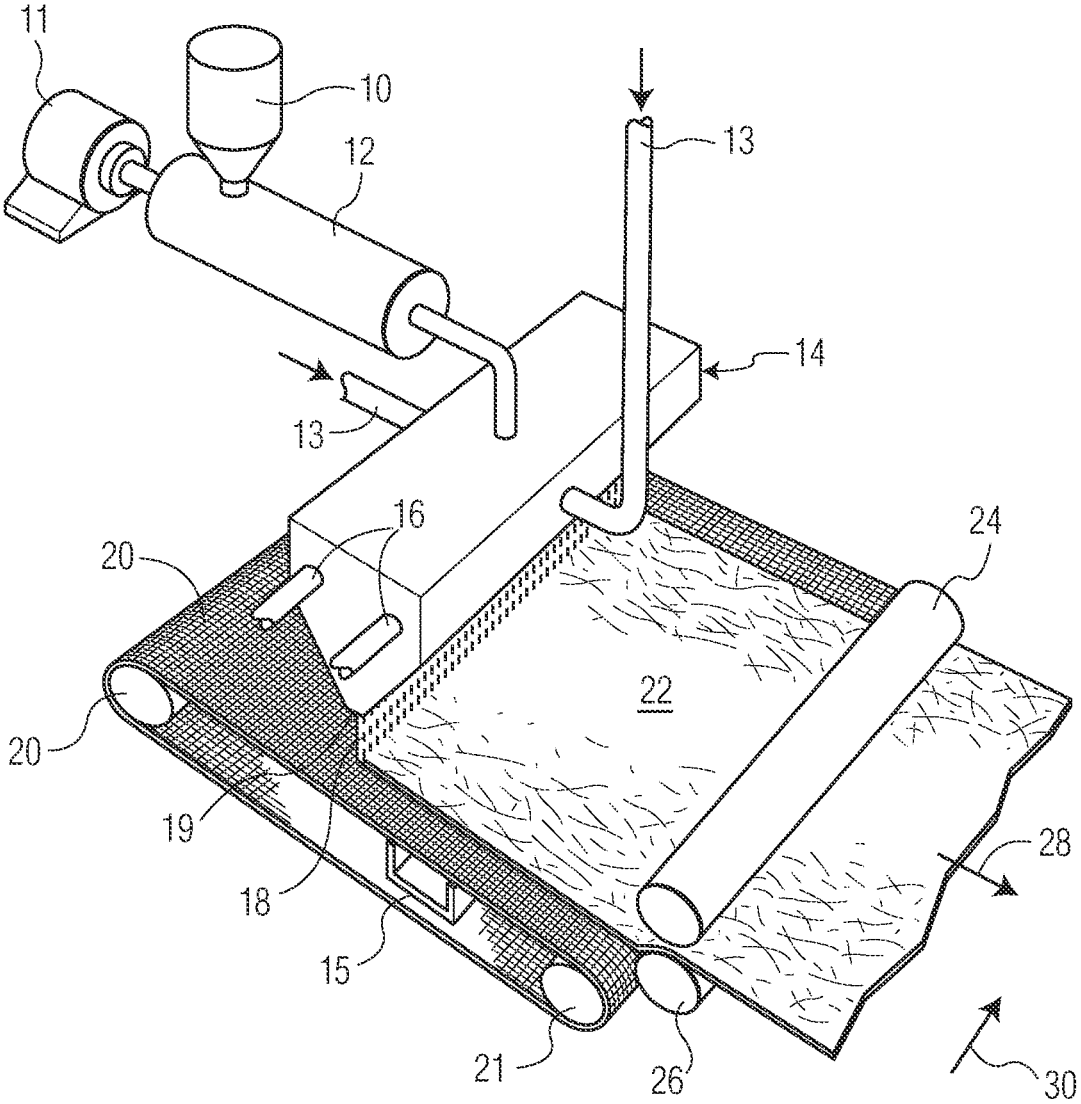
FIG. 1 shows a schematic of a meltblowing process.

The present disclosure generally relates to meltblowing processes and equipment including meltblowing dies. In some implementations, the die has passages that direct fluid (e.g., air) flows towards the polymer flows exiting the die to attenuate the polymer streams. To reduce turbulence in the fluid flows, which can have negative impacts on nonwoven formation from these polymer streams, the passages include air shaping devices that disrupt and/or re-direct the fluid flows to reduce turbulence in the flows and/or minimize velocity variances across flows. Such dies are described in more detail below.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "nonwoven web" means a web having a structure of individual fibers or threads which are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters useful are usually expressed in microns, or in the case of staple fibers, denier. It is noted that to convert from osy to gsm, multiply osy by 33.91.

"Meltblown" refers to fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameters. Thereafter, the meltblown fibers are carried by the high velocity gas stream and are deposited on a collecting surface to form a web of randomly dispersed meltblown fibers. Meltblowing processes can be used to make fibers of various dimensions, including macrofibers (with average diameters from about 40 to about 100 microns), textile-type fibers (with average diameters between about 10 and about 40 microns), and microfibers (with average diameters less than about 10 microns). Meltblowing processes are particularly suited to making microfibers, including ultra-fine microfibers (with average diameters of about 3 microns or less). Meltblown fibers may be continuous or discontinuous, and are generally self-bonding when deposited onto a collecting surface. The meltblown process is well-known and is described by various patents and publications described above.

The term "machine direction" as used herein refers to the direction of travel of the forming fabric or belt onto which fibers are deposited during formation of a material.

The term "cross machine direction" as used herein refers to the direction in the same plane of the web being formed which is perpendicular to machine direction.

FIG. 1 schematic of a meltblowing process. Generally described, in a meltblowing process, a hopper 10 provides polymer to extruder 12 which is driven by motor 11 and heated to bring the polymer to the desired temperature and viscosity to allow it to flow. This molten polymer is then provided to the die 14. In some implementations the die 14 may be heated by the heater 16. The die 14 is connected by conduits 13 to a source of attenuating fluid (e.g., air). At the exit 19 of the die 14, fibers 18 are formed, elongated by the attenuating fluid and then collected on a forming belt 20, with the aid of an optional suction box 15, to create a nonwoven web of fibers 22. This web of fibers 22 may be compacted or otherwise bonded or consolidated, for example, by rolls 24 and 26. The belt 20 can be driven/rotated in a machine direction (shown by arrow 28) by a driven roll such as roll 21 or 23. The arrow 30 shows a direction perpendicular to the machine direction 28, and is referred to as the cross-machine direction 30.

Figure 2:
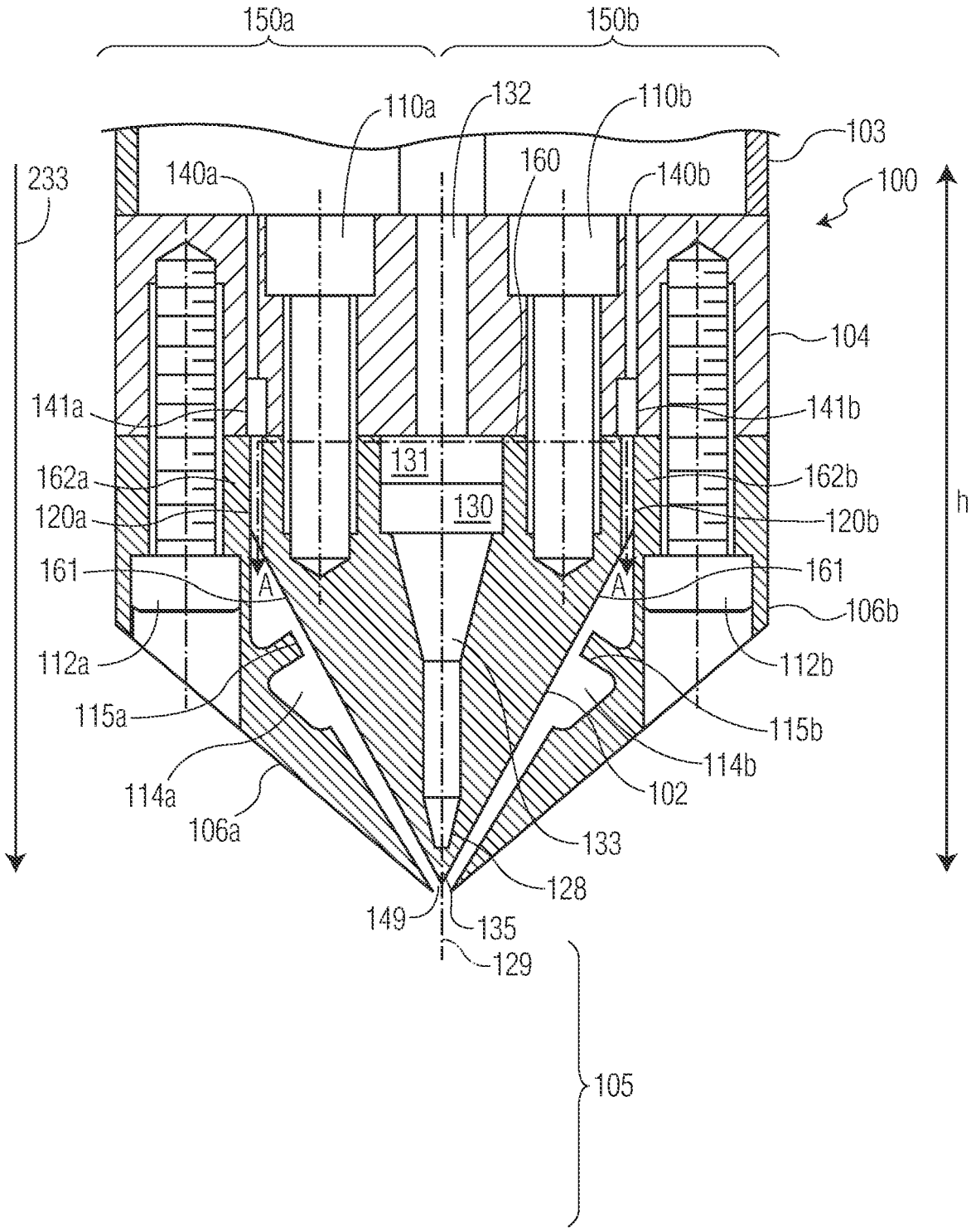
FIG. 2 shows a cross-section view of a meltblowing die.

FIG. 2 shows an example meltblowing die 100 in a partial cross-sectional view. The meltblowing die 100, in some implementations, includes a die tip 102 mounted to a die body 103. In some implementations the die body 103 includes a mounting plate 104 and the die tip 102 is mounted to the die body 103 through the mounting plate 104 (e.g., through bolts 110*a* and 110*b*). The die tip 102 functions to supply (molten) polymer material, through one or more capillaries 135 at the outlet 129 of the die tip 102, to the forming zone 105. The forming zone 105 is an area between the die tip 102 and the forming belt 20 where the fibers 22 are stretched and (optionally) cooled before being deposited on the forming belt 20. The die body 103 provides, at least in part, as a fluid plenum (to aid in distribution of attenuating fluid flowing through the die 100) and provide structural integrity to the die 100.

In some implementations, the die 100 also includes air plates 106*a* and 106*b* (e.g., first and second air plates). The air plates 106*a* and 106*b* function to (at least partially) form or provide passages 120*a* and 120*b*, which direct attenuating fluid, through one or more interior portions of portions of the die 100, towards the outlet 129 to elongate, thin and/or cool the fibers 22 extruded from the capillaries 135 before being deposited on the forming belt 20. In some implementations, the passages 120*a* and 120*b* change cross-sectional shape and/or size in various portions of the die 100 to manage and control the flow of attenuating fluid (e.g., to mix the attenuating fluid, increase its velocity, reduce turbulence, etc.).

In some implementations, the air plates 106*a* and 106*b* are integral to the die tip 102, and the passages 120*a* and 120*b* are formed or partly formed through a machining (e.g., milling or drilling), additive printing (e.g., 3D printing) or etching the die tip 102 and/or the air plates 106*a* and 106*b*. In other implementations, the air plates 106 and 106*b* are manufactured separately from the die tip 102 and cooperate with the die tip 102 to form the passages 120*a* and 120*b*, as described in more detail below. In some implementations (e.g., where the air plates 106*a* and 106*b* are separate components from the die tip 102), the air plates 106*a* and 106*b* are mounted (directly or indirectly) to the mounting plate 104 (e.g., through bolts 112*a* and 112*b*) or, alternately or additionally, to the die body 103 or the die tip 102.

In some implementations the die tip 102 has a die tip apex 128 and a breaker plate/screen assembly 130. The material, e.g., polymeric pellets, which will be formed into fibers, is provided from the die body 103 to the die tip 102 through passageway 132. In some implementations, the material passes through distribution plate 131 from the passageway 132 to the breaker plate/screen assembly 130. The breaker plate/filter assembly 130 functions to filter the polymeric material to prevent any impurities embedded in the material from clogging the die tip 102. In some implementations, the material then moves through the passage 133 to one or more capillaries 135, which extrude the material out to the outlet 129 to form fiber streams. The outlet 129, for example, will generally have a diameter in range of about 0.1 to about 0.6 mm. The capillaries 135, in some implementations, each have a diameter about the same as that of the outlet 129, and have a height (e.g., along the (h) axis as shown in FIG. 2) which is generally about 3 to 15 times the diameter of the capillaries 135.

A high-velocity fluid (e.g., air) is provided proximate or at the die tip outlet 129 to attenuate the fibers. In some implementations, the attenuating fluid is supplied through the die body 103, or supplied external to the die body 103. In some implementations, the attenuating fluid is directed through the die 100 by a passage 120*a* in a first side 150*a* of the die 100 and by a passage 120*b* in the second side 150*b* of the die and out to the outlet 129 (e.g., one outlet opening on each side of the die 100 corresponding to each of the passages 120*a* and 120*b*).

As described above, in some implementations, the die tip 102 and air plates 106*a* and 106*b* define or otherwise (at least partially) form the passages 120*a* and 120*b*. For example, the air plate 106*a* defines an exterior most (left-most when looking at FIG. 2) portion (e.g., side or wall) of the passage 120*a* with the opposing interior portion (e.g., side or wall) of the passage 120*a* being defined by the die tip 102, and the air plate 106*b* defines an exterior most (right-most when looking at FIG. 2) portion of the passage 120*b* with the opposing interior portion of the passage 120*b* being defined by the die tip 102.

In some implementations, as described above, the die tip 102 and the air plates 106*a* and 106*b* are integral (e.g., monolithic or connected through a permanent means like welded, as opposed to connected together through non-permanent means such as removable bolts) such that the air plates 106*a* and 106*b* can be thought of as (in an axis parallel to the machine direction 28) the exterior most portions of at least part of the die tip 102. In these implementations, the passages 120*a* and 120*b* can be formed, for example, through a machining/milling-type process, etching, casting or 3D printing-type process in the die tip 102 or the air plates 106*a* and 106*b*, or partly by the air plates 106*a* and 106*b* and partly by the die tip 102, as described below.

Figure 3A:
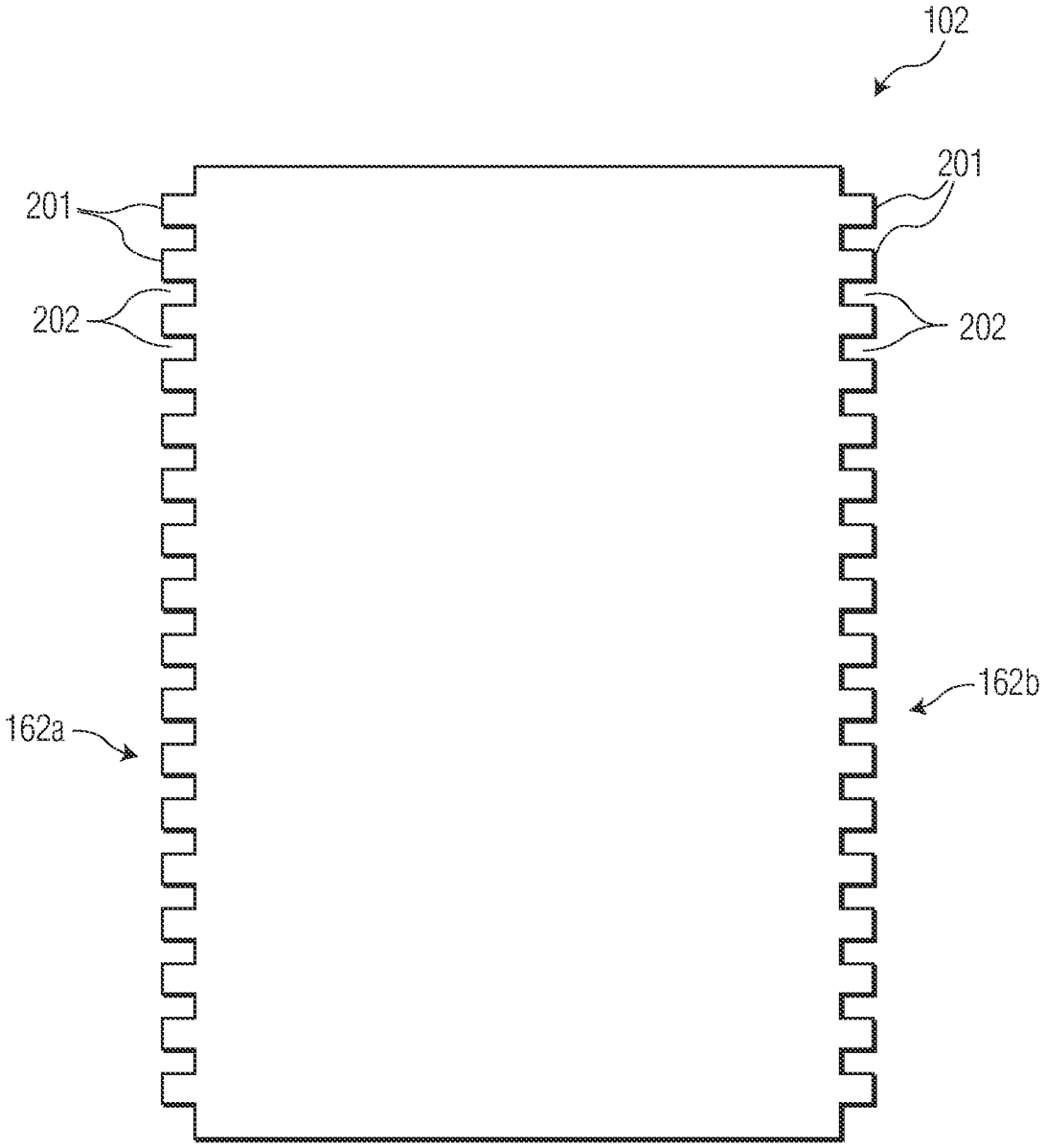
FIG. 3A shows a partial top view of a meltblowing die tip portion of FIG. 2.

FIG. 3A shows a top view of the die tip 102, looking down onto surface 160 along section line A-A in FIG. 2. For example, in some implementations, the sides of the die tip 162*a* and 162*b* are opposite each other and each have channels 202 extending, at least partially, along the path through which the attenuating fluid enters the die 100 to where the attenuating fluid exits the die 100 (e.g., proximate the outlet 129). In some implementations, this attenuating fluid path is generally along (e.g., parallel to) the axis defined by the die tip's height (h) (see FIG. 2).

The die tip 102 can also include raised portions 201 separating adjacent channels 202 to form, at least partially, one or more (cross-sectional) sides of the passages 120*a* and 120*b* (e.g., three sides for a rectangular cross-sectioned passage or a half circle for a circular cross-sectioned passage). In these implementations, the respective air plates 106*a* and 106*b* are fitted against or otherwise engage the raised portions 201 to form, at least partially, one or more (cross-sectional) sides or surfaces of the passages 120*a* and 120*b* (e.g., a fourth side or surface for a rectangular cross-sectioned passage or the half circle to close a circular cross-sectioned passage). In this way the attenuating fluid can enter the die 100 and be directed by the passages 120*a* and 120*b* to proximate the outlet 129.

Figure 3B:
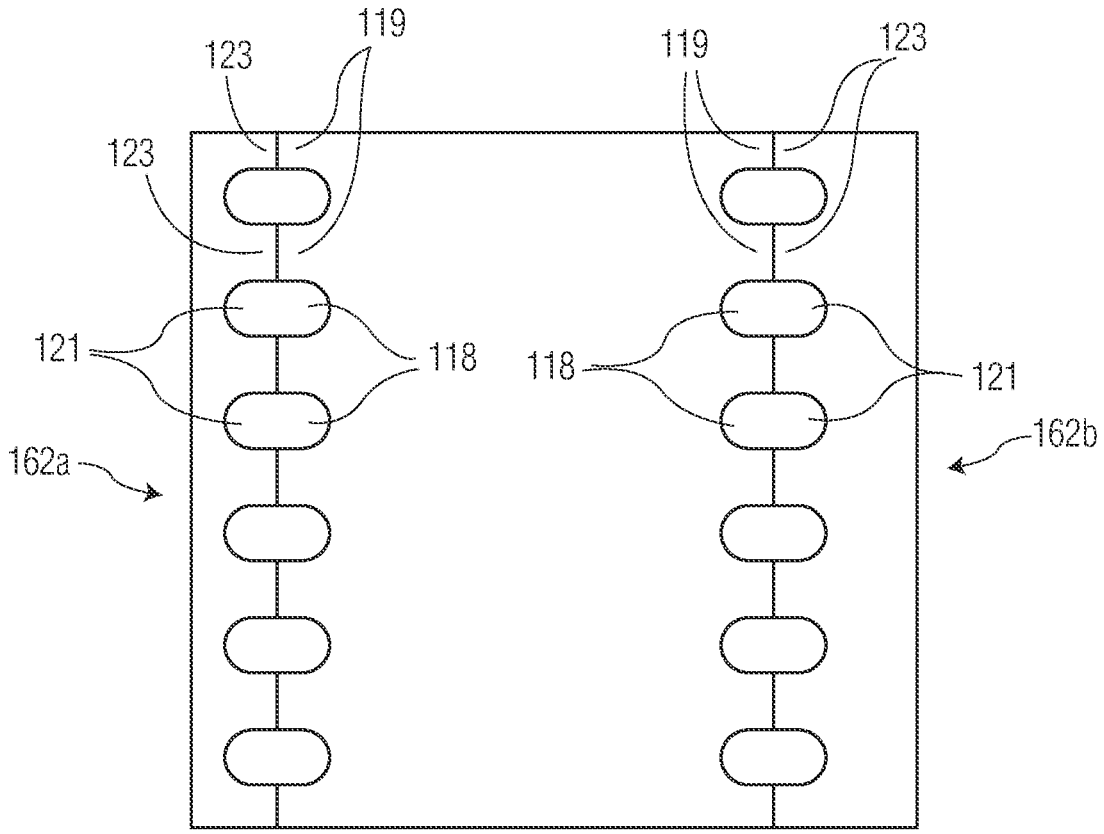
FIG. 3B shows a partial top view of a meltblowing die tip portion of another implementation.

In some implementations, as shown in FIG. 3B (also a top view of the die tip 102 similar to that of FIG. 3A), the sides of the air plates 106*a* and 106*b* have air guide trenches 121 or cut-outs 121 extending, at least partially, along the die tip's height (h) with air guide extensions 123 separating adjacent air guide trenches 121 such that the respective air guide extensions 123 engage the die side extensions 119 to at least partially form the passages 120*a* and 120*b*. More generally, with respect to a cross section of the passages 120*a* and 120*b*, e.g., as shown in FIG. 3B, the air plates 106 and 106*b* can define a portion of the cross section and the die tip 102 can define the remaining portion of the cross section to form at least part of the passages 120*a* and 120*b*.

In some implementations, as described above, the cross section of some or all passages 120*a* and 120*b* is non-rectangular in shape such as, for example, oval or circular, as shown in FIG. 3B. This cross section is transverse to the general direction of fluid flow in the passages 120*a* and 120*b*. In other implementations, the cross section of the passages 120*a* and 120*b* is rectangular or some of the passages 120*a* and 120*b* have non-rectangular cross-sections and others have rectangular cross-sections. Depending on the configuration of the die 100, in some implementations, passages 120*a* and 120*b* have non-rectangular cross-sections that can reduce attenuating fluid turbulence in the passages 120*a* and 120*b*.

Figure 4:
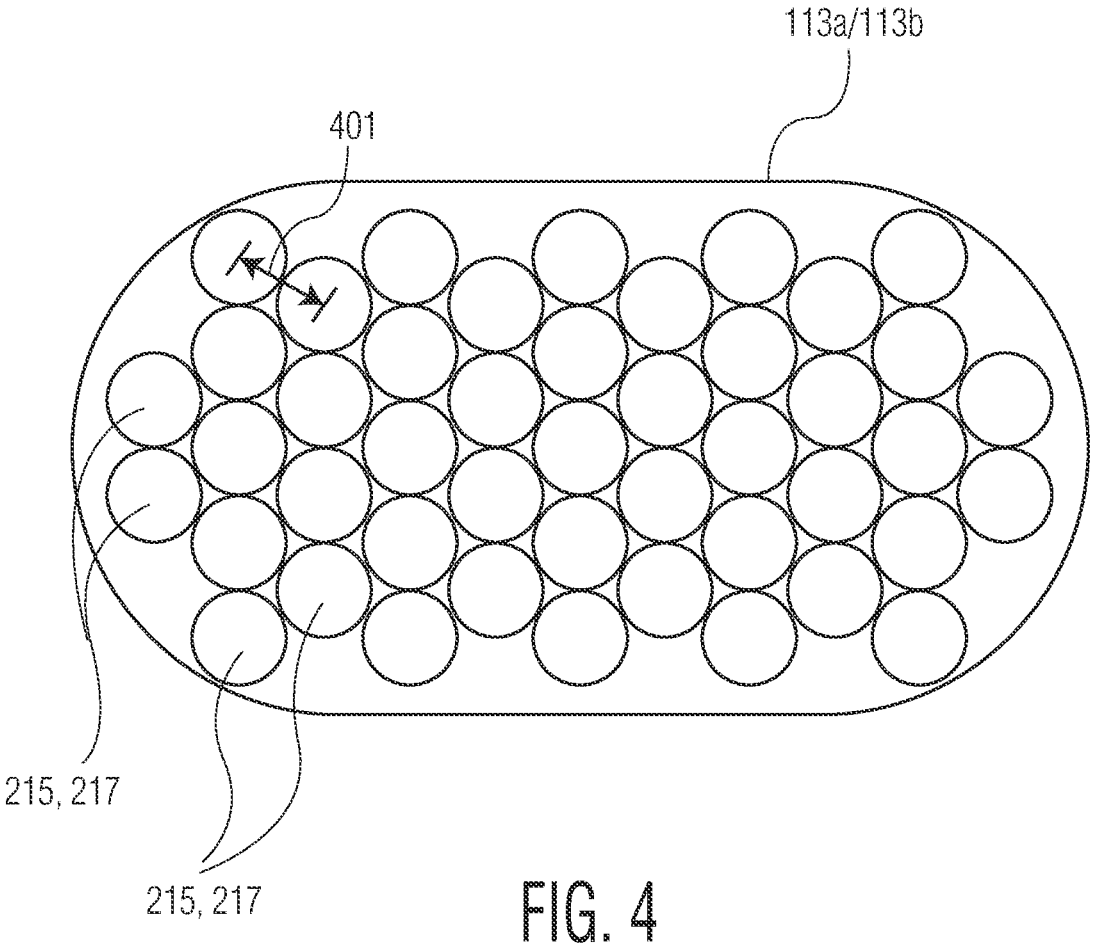
FIG. 4 shows a detail view of a cross-section of a passage.

The passages 120*a* and 120*b* can include or have one or more air management devices 215, as shown in FIG. 4, which shows a cross section (e.g., transverse to the main flow of attenuating fluid) of an example passage 120*a* or 120*b*. In some implementations, each air management device 215 has one or more air shaping devices 217. For example, an air management device 215 can be a honeycomb plate or wire mesh screen placed transverse (e.g., or generally transverse from −45 to +45 degrees or from −10 to 10 degrees or from −5 to 5 degrees) to the main flow of attenuating fluid (indicated by arrow 233 in FIG. 2) in the respective passages 120*a* and 120*b*, and, optionally, can span from one side of the cross-sectional interior region of a passage 120*a* and 120*b* to the other side of the cross-sectional interior region of a passage 120*a* and 120*b*. In some implementations the air management device spans the entire cross section of the interior region of a passage 120*a* and 120*b* More generally described, the air management device 215 is a device in a passage 120*a* and/or 120*b* that reduces attenuating fluid turbulence within a passage 120*a* or 120*b* or at or beyond the outlet 129, and the air shaping devices 217 are individual features of the air management device 215 used to re-arrange attenuating fluid flow in (or coming out of) the passages 120*a* and 120*b*. For example, if the air management device 215 is a honeycomb plate 215 then an air shaping device 217 is an opening in the honeycomb plate 215 to cause the flow of attenuating fluid to change or be altered to reduce turbulence. Other air management device configurations (beyond a honeycomb design) are also envisioned such as, for example, wire mesh screens.

In implementations where the air management device 215 has a honeycomb configuration with the air shaping devices 217 can be modeled as a porous media in fluent simulation with a face permeability of 5.56E-10 $m^2$, a porous medium thickness of 0.000143 m, and a pressure-jump coefficient (c2) of 94035. Thus possible honeycomb plate designs 215 and other air management device 215 configurations/designs include those, for example, that meet this porous media model/criteria. In some implementations, the cross-sectional area of a passage 120*a* and 120*b* ranges from, for example, 0.005 to about 0.05 square inches, or from 0.01 to about 0.03 square inches.

The amount of turbulence can be described by a ratio of a magnitude of a velocity of the attenuating fluid flow in a passage 120*a* and 120*b* to a median velocity of the attenuating fluid flow in the passages 120*a* and 120*b* ("Turbulence Measure"). The magnitude of a velocity of the attenuating fluid flow describes velocity magnitude at a given location in a passage 120*a* and 120*b*. The median velocity of the attenuating fluid flow describes median velocity over time at the given location in a passage 120*a* and 120*b*. In some implementations this location is in the passage 120*a* and 120*b* at the exit of the die body 103 at the die tip 102 or the exit of the die tip 102 (e.g., at the plane of the outlet 129). The closer the Turbulence Measure is to 1 the more uniform the attenuating fluid flow is with less turbulence. Further, the longer period of time the Turbulence Measure is closer to one the better as that means the longer the flow is more uniform.

A finite element modeling simulation using the ANSYS Fluent 17.1 software package available from ANSYS, Inc., was used to model a passage (e.g., passages 120*a* and 120*b*)

having a rectangular cross section and a passage having an oval cross section similar to that shown in FIG. 3B. The dimensions (length and width respectively) of the rectangular cross section are 0.118 inches and 0.118 inches, and the oval cross section are 0.118 inches and 0.118 inches with rounded corners.

Figure 5:
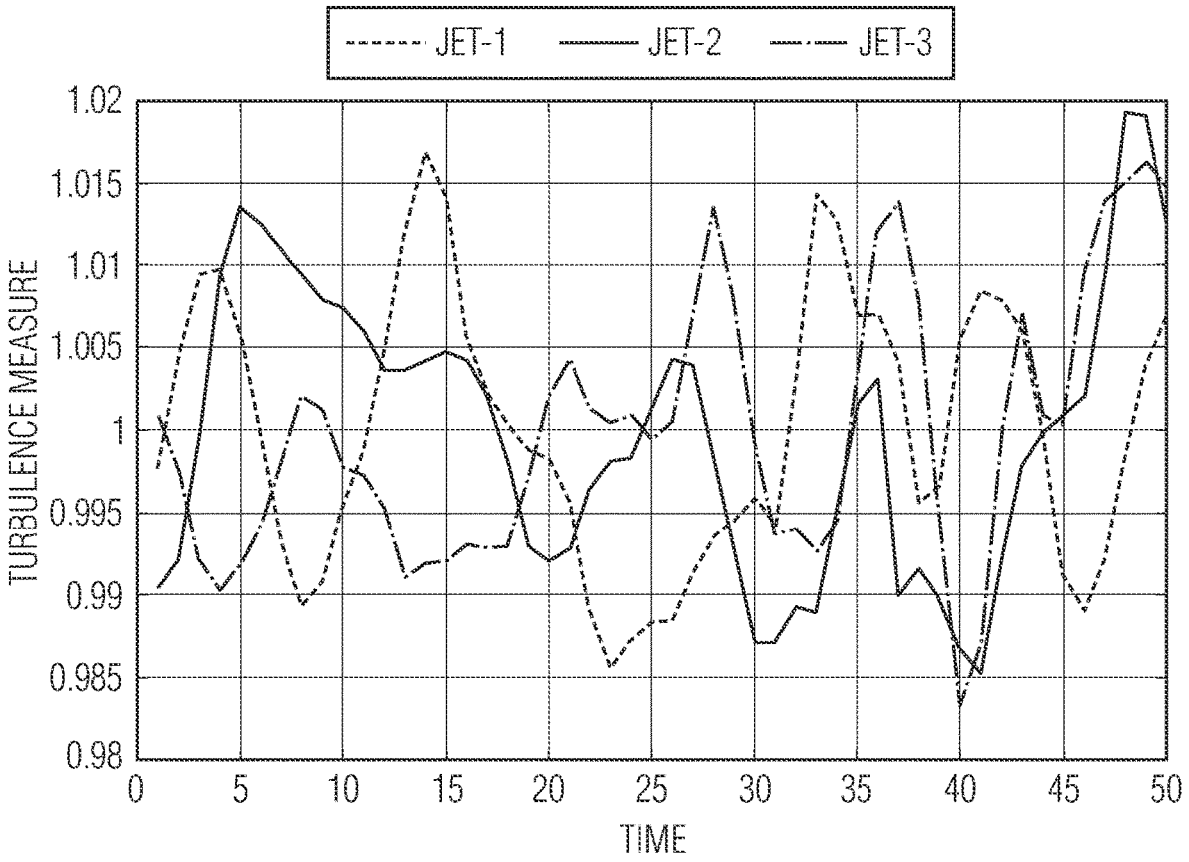
FIG. 5 shows a graph of the Turbulence Measure for a baseline configuration.

For all the following examples/models, the Turbulence Measure is measured at the horizontal plane of outlet 129 of the die tip 102. For a baseline simulation the model was based on a passage 120*a* and 120*b* with a rectangular cross section and no air management device 215. The Turbulence Measure over time for this baseline case is shown in FIG. 5, and has Turbulence Measures ranging from about 1.02 to about 0.985 across a 0.1 second period. Each of the lines "jet-1," "jet-2," and "jet-3 are flow for different capillaries 135 of the die tip 102.

Figure 6:
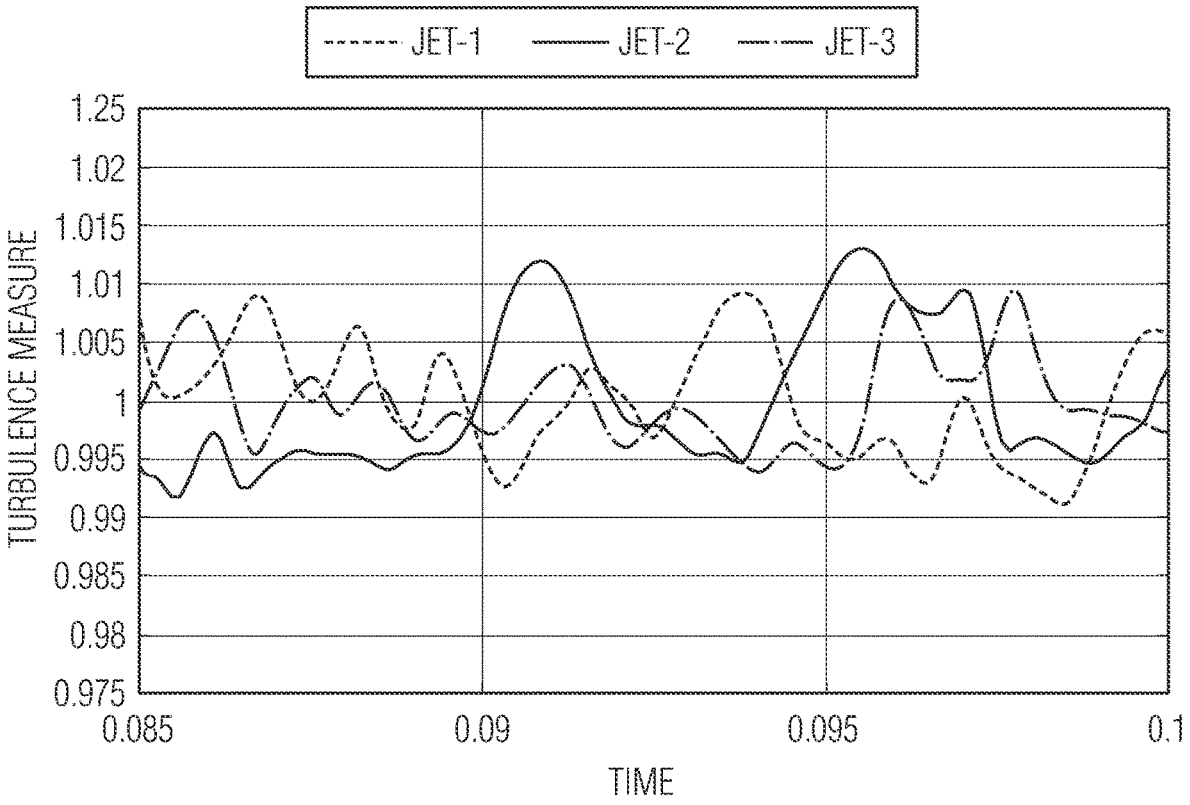
FIG. 6 shows a graph of the Turbulence Measure for a wire mesh screen configuration.

For a second simulation the model was based on a passage 120*a* and 120*b* with a rectangular cross section and a wire mesh screen as the air management device 215. The wire mesh screen has the following properties: wire density of 100 wires/inch, wire diameter of 0.0045 inches, wire spacing of 0.0055 inches and an open area of 30.3%, placed in a passage with a rectangular cross section. As shown in FIG. 6, the Turbulence Measure over time for this second simulation ranges from about 1.013 to about 0.997 across a 0.1 second period. This second simulation shows the Turbulence Measure is closer to one than the baseline case so this results in a more uniform (and desirable) attenuating fluid flow.

Figure 7:
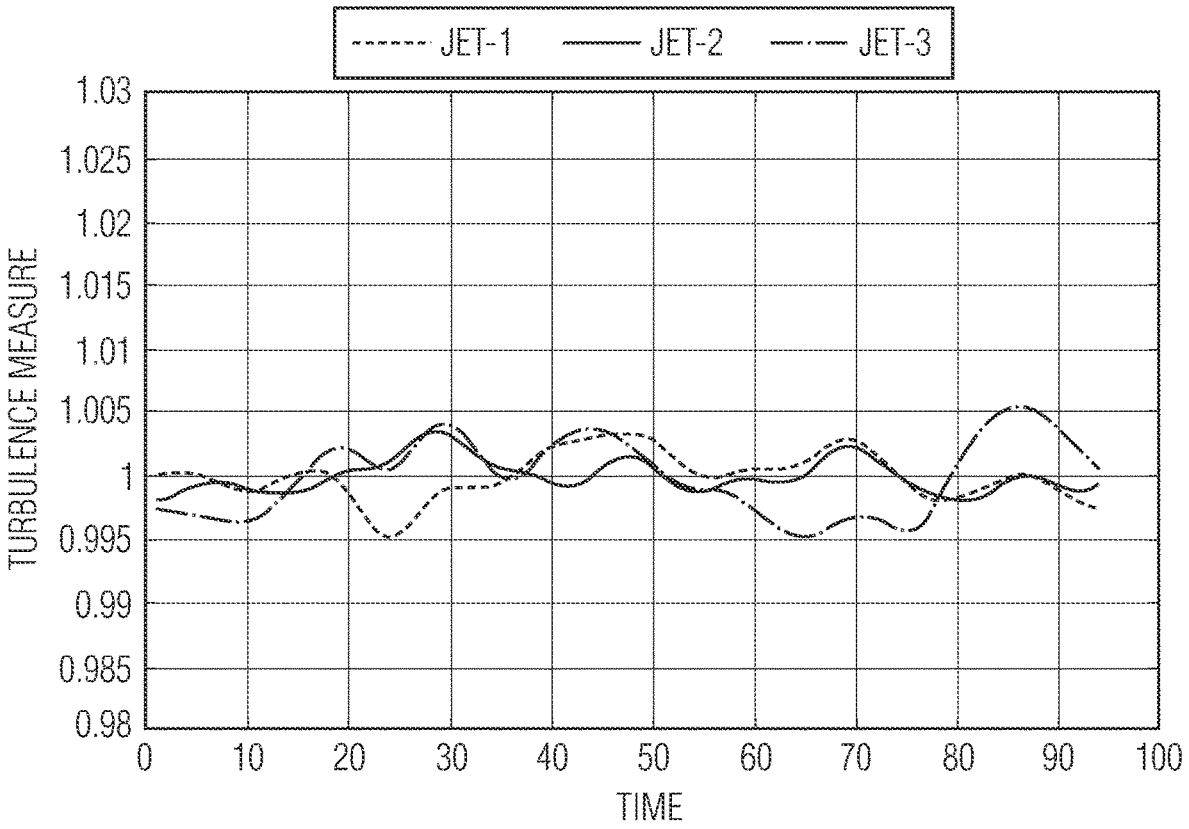
FIG. 7 shows a graph of the Turbulence Measure for a honeycomb plate configuration.

For a third simulation the model was based on a passage 120*a* and 120*b* with a rectangular cross section and a honeycomb plate as the aft management device 215. The honeycomb plate was modeled as porous media approximation in fluent simulation with a face permeability of 5.56E-10 $m^2$, a porous medium thickness of 0.000143 m, and a pressure-jump coefficient (c2) of 94035. As shown in FIG. 7, the Turbulence Measure over time for this third simulation ranges from about 1.005 to about 0.995 across a 0.1 second period. This third simulation shows the Turbulence Measure is closer to one than the baseline and second simulation cases so this results in an even more uniform (and desirable) attenuating fluid flow.

Figure 8:
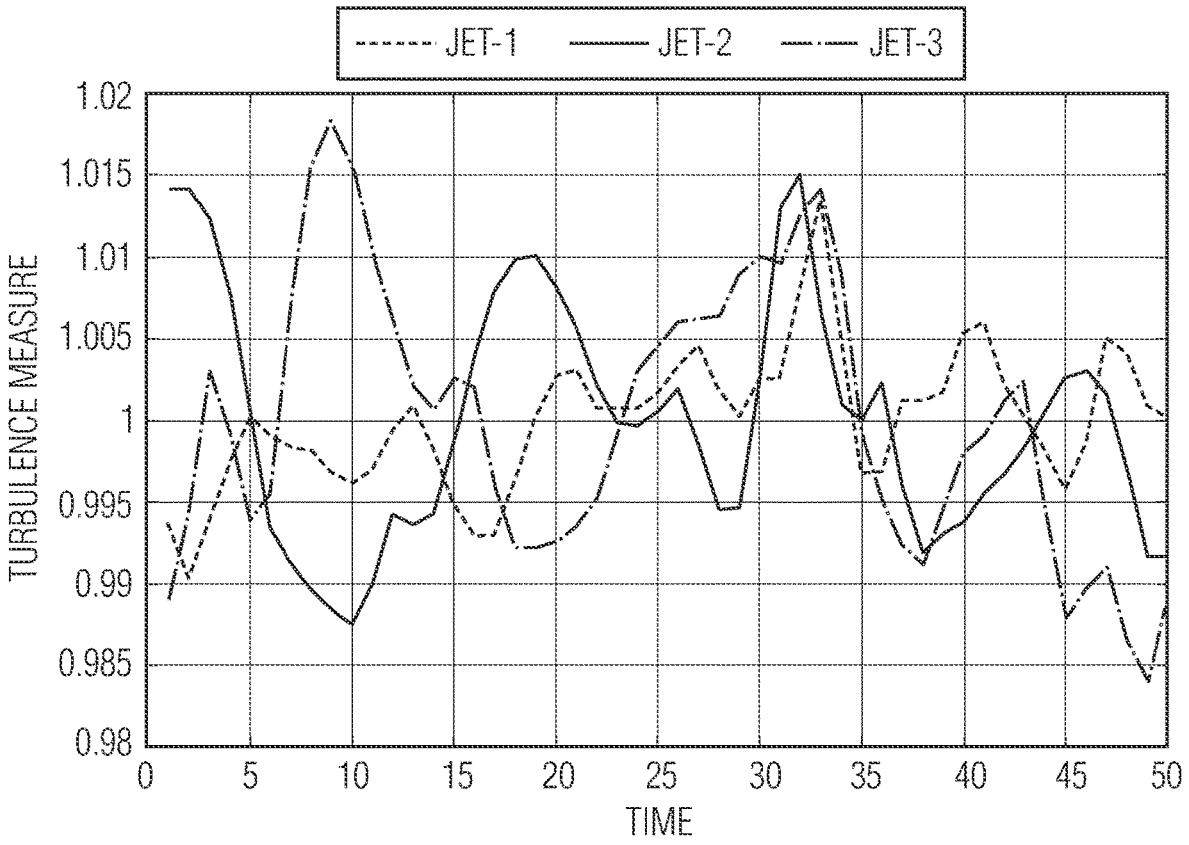
FIG. 8 shows a graph of the Turbulence Measure for an oval cross section configuration.

For a fourth simulation the model was based on a passage 120*a* and 120*b* with an oval cross section and no air management device 215. As shown in FIG. 8, the Turbulence Measure over time for this fourth simulation ranges from about 1.018 to about 0.984 across a 0.1 second period. This fourth simulation shows the Turbulence Measure is better than the baseline but less desirable than the second or third simulations (assuming minimizing Turbulence Measurement variance is the goal).

In some implementations, the meltblown die 100 has a machine direction width of less than about 16 cm (6.25 in) with some having a machine direction width in the range of about 2.5 cm (1 inch) to about 15 cm (5.9 inches) and desirably about 5 cm (2 inches) to about 12 cm (4.7 inches).

In some implementations the die tip 102 can be manufactured from materials conventionally used for manufacturing die tips such as stainless steel, aluminum, carbon steel or brass. In other implementations, the die tip 102 is manufactured from insulating materials. The die tip 102 may be constructed of one piece or may be of multi-piece construction, and the die openings may be drilled or otherwise formed.

The fibers produced using the meltblowing die 100 can be prepared from any polymer, in particular, any thermoplastic polymer. Polymers suitable for the present invention include the known polymers suitable for production of nonwoven webs and materials such as for example polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(l-butene) and poly(2-butene); polypentene, e.g., poly(l-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polylactide, and polylactic acid polymers and polyhydroxyalkanoate (PHA), as well as polyethylene terephthalate, poly-butylene terephthalate, polytetramethylene terephthalate, polycyclohexylene-1,4-dimethylene terephthalate, and isophthalate copolymers thereof, as well as blends thereof. The particular polymer selected will depend on the intended use of the resulting nonwoven web. In addition to the polymer, other additives, such as colorants, fillers and process aids may be present in the material which is to be formed into fibers.

The selection of a particular attenuating fluid will depend on the polymer being extruded and other factors such as cost. In most cases, the attenuating fluid will be air. It is contemplated that available air from a compressor may be used as the attenuating fluid. In some cases it may be necessary to cool the air in order to maintain a desired temperature differential between the heated polymer and the attenuating fluid. In addition to air, other available inert gases may be used for attenuating.

Embodiments

Embodiment 1. A meltblown die comprising a die body; a die tip mounted to the die body and having one or more capillaries, wherein the die tip is configured to direct polymer out through the one or more capillaries into a forming zone, a plurality of passages having an interior region and configured to direct attenuating fluid through the interior region and out into the forming zone; and an air management device having a plurality of air shaping devices, wherein the air management device is at least partially within at least one of the plurality of passages, and the plurality of aft shaping devices are configured to re-arrange air flow in the at least one of the plurality of passages to reduce turbulence of the attenuating fluid in at least one of the interior region and the forming zone Embodiment 2. The meltblown die of embodiment 1 comprising a first air plate at least partially forming one or more of the plurality of passages.

Embodiment 3. The meltblown die of embodiment 2 comprising a second air plate at least partially forming at least one of the plurality of passages different from the one or more of the plurality of passages.

Embodiment 4. The meltblown die of embodiments 1-3, wherein at least one of the plurality of passages have a fluid flow having a ratio of a magnitude of a velocity of the fluid flow to a median velocity of the fluid flow of 0.995 to 1.005 during at least a time period.

Embodiment 5. The meltblown die of embodiment 4, wherein the time period is 0.03 to 0.04 seconds.

Embodiment 6. The meltblown die of embodiment 4, wherein the time period is 0.03 to 0.05 seconds.

Embodiment 7. The meltblown die of embodiment 4, wherein the time period is 0.03 to 0.07 seconds.

Embodiment 8. The meltblown die of embodiment 4, wherein the time period is 0.03 to 0.08 seconds.

Embodiment 9. The meltblown die of embodiment 4, wherein the time period is 0.03 to 0.01 seconds.

Embodiment 10. The meltblown die of embodiment 4, wherein the time period is 0.05 to 0.08 seconds.

Embodiment 11. The meltblown die of embodiment 4, wherein the time period is 0.08 to 0.1 seconds.

Embodiment 12. The meltblown die of embodiments 1-11, wherein at least one of the plurality of air shaping devices has an opening with a diameter or width of 0.0029 inches to 0.0059 inches in a direction generally transverse to the fluid flow.

Embodiment 13. The meltblown die of embodiments 1-12, wherein at least one of the plurality of passages have a non-rectangular cross-section.

Embodiment 14. The meltblown die of embodiments 1-13, wherein the non-rectangular cross-section is an oval.

Embodiment 15. The meltblown die of embodiments 1-14, wherein the air management device comprises a wire mesh screen.

Embodiment 16. The meltblown die of embodiments 1-14, wherein the air management device comprises a honeycomb plate.

Embodiment 17. A method of making meltblown fibers comprising: directing fluid flow through a plurality of non-rectangular passages in through a die to a die outlet to attenuate polymer extruded by the die, wherein at least one of the plurality of passages has an air management device having a plurality of air shaping devices; and re-arranging, by the respective plurality of air shaping devices, the fluid flow in the at least one of the plurality of passages.

Embodiment 18. The method of embodiment 17, wherein the re-arranged fluid flow has a ratio of a magnitude of a velocity of the redirected fluid flow to a median velocity of the redirected fluid flow of 0.995 to 1.005 during at least a time period.

Embodiment 19. The method of embodiment 17, wherein the time period is 0.05 to 0.1 seconds.

Embodiment 20. The method of embodiment 17, wherein the non-rectangular cross-section is an oval.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A meltblown die comprising:

a die body;

a die tip mounted to the die body and having one or more capillaries, wherein the die tip is configured to direct polymer out through the one or more capillaries into a forming zone, a plurality of passages each having an interior region and located in the die tip, and configured to direct attenuating fluid through the interior region and out into the forming zone; and an air management device having a plurality of air shaping devices, wherein the air management device is placed at least partially within the interior region of at least one of the plurality of passages, and the plurality of air shaping devices are configured to re-arrange air flow in the at least one of the plurality of passages to reduce turbulence of the attenuating fluid in at least one of the interior region and the forming zone.

2. The meltblown die of claim 1 comprising a first air plate at least partially forming one or more of the plurality of passages.

3. The meltblown die of claim 2, comprising a second air plate at least partially forming at least one of the plurality of passages different from the one or more of the plurality of passages.

4. The meltblown die of claim 1, wherein at least one of the plurality of passages have a fluid flow having a ratio of a magnitude of a velocity of the fluid flow to a median velocity of the fluid flow of 0.995 to 1.005 during at least a time period.

5. The meltblown die of claim 4, wherein the time period is 0.03 to 0.04 seconds.

6. The meltblown die of claim 4, wherein the time period is 0.03 to 0.05 seconds.

7. The meltblown die of claim 4, wherein the time period is 0.03 to 0.07 seconds.

8. The meltblown die of claim 4, wherein the time period is 0.03 to 0.08 seconds.

9. The meltblown die of claim 4, wherein the time period is 0.03 to 0.01 seconds.

10. The meltblown die of claim 4, wherein the time period is 0.05 to 0.08 seconds.

11. The meltblown die of claim 4, wherein the time period is 0.08 to 0.1 seconds.

12. The meltblown die of claim 1, wherein at least one of the plurality of air shaping devices has an opening with a diameter 0.0029 inches to 0.0059 inches in a direction generally transverse to the fluid flow.

13. The meltblown die of claim 1, wherein at least one of the plurality of passages have a non-rectangular cross-section.

14. The meltblown die of claim 13, wherein the non-rectangular cross-section is an oval.

15. The meltblown die of claim 1, wherein the air management device comprises a wire mesh screen.

16. The meltblown die of claim 1, wherein the air management device comprises a honeycomb plate.

17. A method of making meltblown fibers comprising:

directing fluid flow through a meltblown die according to claim 1 toward a die outlet to attenuate polymer extruded by the die; and re-arranging the fluid flow by the plurality of air shaping devices of the air management device.

18. The method of claim 17, wherein the re-arranged fluid flow has a ratio of a magnitude of a velocity of the re-arranged fluid flow to a median velocity of the re-arranged fluid flow of 0.995 to 1.005 during at least a time period.

19. The method of claim 18, wherein the time period is 0.05 to 0.1 seconds.

* * * * *